US005169246A

United States Patent [19]

Bernardis et al.

[11] Patent Number: 5,169,246

[45] Date of Patent: Dec. 8, 1992

[54] REDUCED DIAMETER WIRE TIPS IN A WIRE PRINTING HEAD

[76] Inventors: Francesco Bernardis, Localita Bacciana 8/A, 10010 Chiaverano (TO); Claudio Marangon, Via Sacca 20, 10013 Borgofranco d'Ivrea (TO), both of Italy

[21] Appl. No.: 552,498

[22] Filed: Jul. 16, 1990

[30] Foreign Application Priority Data

Jul. 17, 1989 [IT] Italy ..... 67593 A-89

[51] Int. Cl.[5] ..... B41J 2/25

[52] U.S. Cl. ..... 400/124; 101/93.05

[58] Field of Search ..... 400/124 WD, 124, 67; 101/93.05

[56] References Cited

U.S. PATENT DOCUMENTS 4,117,791 10/1978 Current et al. ..... 112/222
4,268,180 5/1981 Honma ..... 400/124 WD

FOREIGN PATENT DOCUMENTS 11273 2/1981 Japan ..... 400/124
95480 6/1982 Japan ..... 400/124
175673 10/1983 Japan ..... 400/124 WD
111863 6/1984 Japan ..... 400/124 WD
11258 1/1986 Japan ..... 400/124 WD
264964 11/1987 Japan ..... 400/124 WD

OTHER PUBLICATIONS

"Blunt Print Tip Wire"; *IBM Tech Dis Bull;* vol. 25 No. 4, pp. 2196-2197; Sep. 1982; G. N. Baker.

"Low Cost Wire Missle Design for a Wire Matrix Printhead"; *IBM Tech Disc Bull.;* R. W. Kulterman et al; vol. 26, No. 1, Jun. 1983, pp. 69-70.

*Primary Examiner*—David A. Wiecking

*Attorney, Agent, or Firm*—Banner, Birch, McKie & Beckett

[57] ABSTRACT

A wire printing head for a high resolution printing machine is provided together with a method for its manufacture. The printer is of the type comprising a printing platen for a recording medium and a carriage transversely movable with respect to the printing platen and mounting the printing head. The head comprises a guide matrix adjacent the platen and a plurality of printing wires or needles guided by the matrix. The wires are capable of longitudinal movement and define on the recording medium printing dots having an area less than the nominal section (Sn) of the wires. Each wire comprises a front portion of constant section (Sr) which is reduced with respect to the nominal section (Sn) and extends for a minimized length of between 0.5 and 4 times inclusive the diameter (Dr) of the reduced section. The guide matrix supports slidably a terminal portion of the wires comprising the nominal section and lodges with play the frontal portion having the reduced section.

11 Claims, 4 Drawing Sheets

REDUCED DIAMETER WIRE TIPS IN A WIRE PRINTING HEAD

BACKGROUND OF THE INVENTION

The present invention relates a wire printing head for a high resolution printing machine and the method for its manufacturing, wherein the printing machine comprises a printing platen for a recording medium and a carriage transversely movable with respect to the printing platen and for mounting the printing head, and wherein the head comprises a guide matrix adjacent to the platen and a plurality of wires having a given nominal section, the wires being guided by holes in the guide matrix and longitudinally movable to define a corresponding plurality of printing dots on the recording medium.

U.S. Pat. No. 5,054,942 discloses a printing head of the above mentioned type, comprising twenty four wires of a diameter of 0.25 mm. This head can be used in a printer forming a dot matrix having a vertical resolution of 1/180 to enable printing of characters similar to characters printed from a printing element using a continuous but heavy profile.

Dot characters having a similar look to characters which have a continuous and thin profile require wires having a diameter of 0.20 mm or less. The printing wires are, on the other hand, subject to relevant stresses either internally and externally of the head. The use of wires with reduced diameter is therefore limited by the fact that the thin wires can be subject to permanent deformations. A first cause of deformation, for combined bending and compressive stress, is determined by the printing stresses which arise on the extremities of the wires at the time of the printing. However, the main cause of deformation is determined by over-stressing by bending to which the printing extremities of the wires which project from the guide matrix can be subject. This occurs, in particular conditions, during movement of the carriage and the printing of the wires, when the same extremities meet with obstacles, for instance sharp variations in the thickness of the recording medium.

There are in commerce printing wires, which provide strokes of different sections along their length, decreasing towards the printing zone. Therefore the guide supports, within the head, require guide holes having a larger diameter than the diameter of the holes of the guide matrix. These wires avoid the problem of deformation for the combined bending and compressive stress but do not avoid the deformations of the terminal parts of reduced section which project from the guide matrix, in the case of over-stress by bending.

SUMMARY OF THE INVENTION

An object of the present invention is to provide a wire printing head for high resolution printers, in which the wires have a high rigidity to the over-stressing in the printing extremities, forming printing dots of reduced imprinting area, and of relatively limited cost.

That object is achieved by the printing head of the invention, wherein each of the printing wires has a front portion of constant reduced section with respect to the nominal wire section and having a minimum transverse dimension, wherein the front portion of reduced section extends longitudinally for a minimized length of between 0.5 and 4 times inclusive the minimum transverse dimension of the reduced section, wherein the guide matrix slidably supports a terminal, nominal section, portion of the wires and wherein the holes of the guide matrix receive the front portion of the wires with clearance therebetween.

The printing head of the invention is manufactured according to a method comprising the following steps: providing on each wire a front portion of constant section, reduced with respect to the nominal section and having a minimum transverse dimension thereof; providing for longitudinal adjustment of the guide matrix relative to the electromagnets actuating the wires; assembling the wires with the electromagnets and the guide matrix so that the guide matrix slidably supports a terminal, nominal section, portion of the wires; moving the guide matrix to cause the front, reduced section, portions of the wires to project from the guide matrix; and grinding the front portions to cause their printing surface to be substantially coplanar with a common surface.

BRIEF DESCRIPTION OF THE DRAWINGS

A preferred embodiment of the invention is set forth in the following description which is given by way of non-limiting example with reference to the accompanying drawings, in which.

DETAILED DESCRIPTION OF THE PREFERRED EMBODIMENTS

Figure 1:
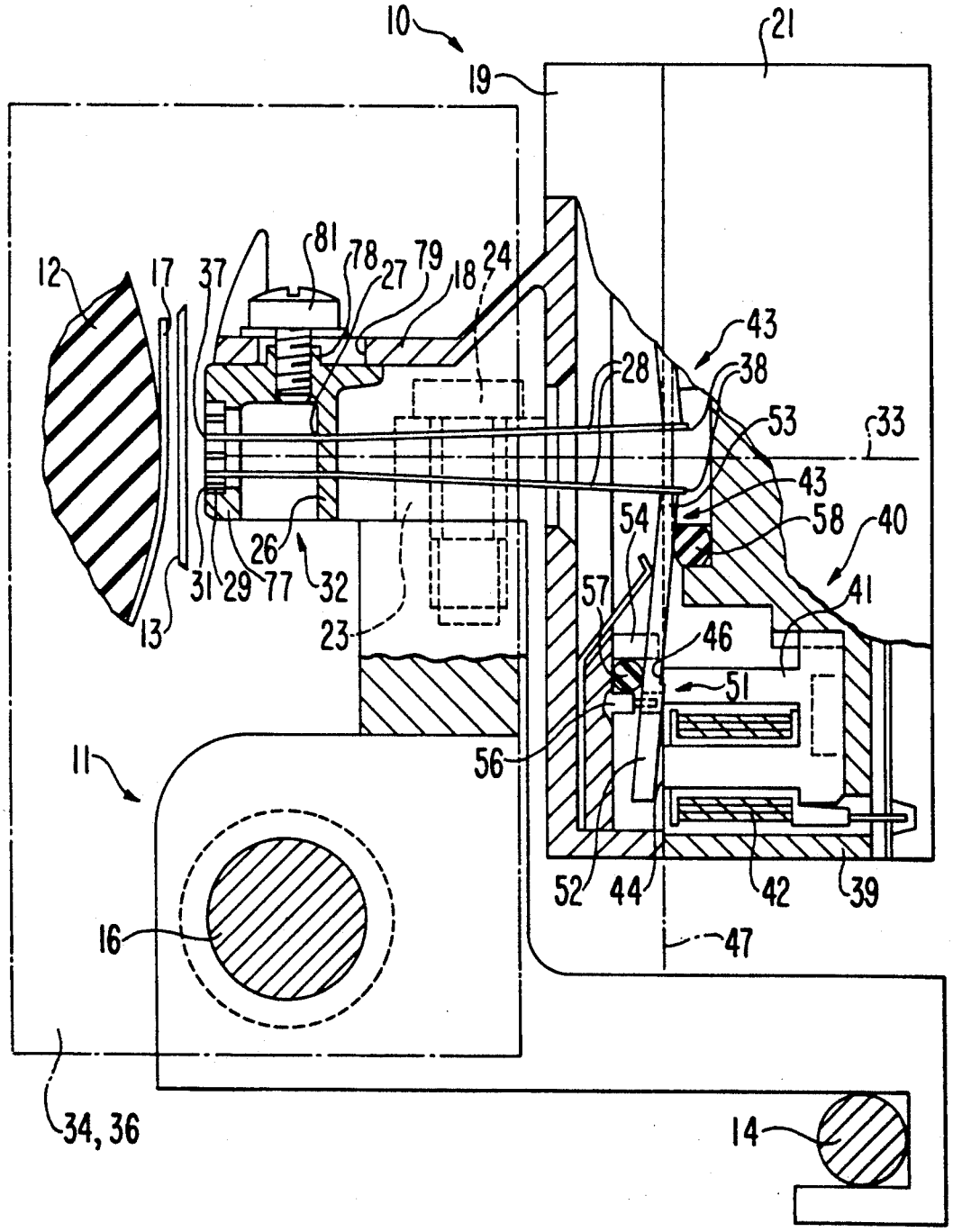
FIG. 1 is a sectional side view of a printing head according to the invention.

Referring to FIG. 1, the printing head embodying the invention is indicated by reference numeral 10 and is applied to a printer of known type, of which are shown a head-mounting carriage 11, a printing platen 12, for example a conventional paper-carrying roller, a printing ribbon 13 and two guide shafts 14 and 16 which support slidably the carriage 11, transversely to the platen 12. The guide shaft 16 provides moreover to adjust the distance of the head 10 from the platen 12, by an adjusting mechanism not shown in the drawings and in a manner known per se, to secure that the head 10 is spaced apart a given distance optimized from a recording medium 17 carried by the platen 12.

The printing head 10 comprises a guide body constituted by a nose 18 directed, in use, towards the platen 12, an intermediate body 19 and an actuating body 21. The guide body is elongate having a "U" shaped inverted section and is provided with lateral flanges 23 for fixing the head 10 to the carriage 11 by screws 24.

Within the nose 18 is mounted a transverse wall 26, comprising guide holes 27 which support and guide a plurality of printing wires or needles 28. A guide matrix 29, formed of a very hard material, for example synthetic ruby, is provided with corresponding guide holes 31 and guides exactly the wires 28 in the terminal portion of the nose 18, adjacent to the platen 12. The holes 27 and 31 define a parallelism zone 32 for the wires 28 between the wall 26 and the matrix 29 in which the wires 28 are parallel to a longitudinal axis 33 of the head 10.

Figure 6:
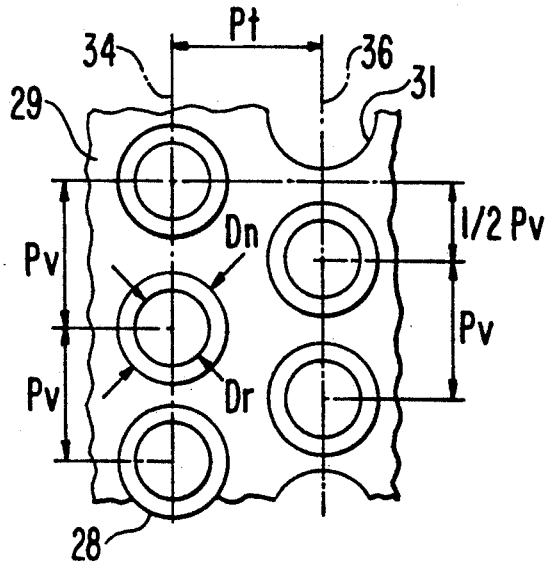
FIG. 6 is a front view of the detail of FIG. 5.

In the zone 32 the wires 28 are disposed along two vertical columns having axes coplanar with two corresponding planes 34 and 36 (see also FIG. 6), parallel with each other and perpendicular to the platen 12. The planes 34 and 36 are spaced by a distance "Pt" and the wires 28 are spaced along the planes 34 and 36 according to a constant vertical pitch "Pv" and such that the wires of the plane 36 are offset by ½ Pv with respect to the wires of the plane 34, in a manner known per se and as shown in FIG. 6.

The wires 28 are made of an extremely hard metallic material, for instance tungsten carbide, tungsten, or special rapid steel. Each wire 28 has a printing extremity 37 directed, in use, toward the platen 12 and an internal extremity 38 lodged inside the actuating body 21.

In a manner well known from the art, the printing of the dots of a character is performed by a pushing or a striking action on the internal extremities 38 of the wires 28 which causes a longitudinal movement of the wires 28 toward the platen 12 and the projection of the printing extremities 37 resulting in transfer of the colored pigments from the printing ribbon 13 to the recording medium 17 carried by the platen 12.

The actuation body 21 comprises a hollow cylindrical body 39, in which are fixed electromagnets 40 in a star configuration. The electromagnets 40 have fixed cores 41, excitation windings 42 and movable armatures 43 which are operative on the extremities 38 of the wires 28.

Each core 41 has two "U" shaped arms, of which a first one is central and the second one is peripherical and is fixed to the cylindrical body 39. The terminal faces of the central and peripheral arms are indicated with reference numerals 44 and 46, are coplanar with a plane 47 perpendicular to the axis 33 and have radial symmetry.

The movable armatures 43 have an elongated rectangular shape and are in a star-like configuration, partially in front of the faces 44 and 46 of the cores 41. The armatures 43 have an intermediate portion with a step configuration 51, a radially external extremity 52 and a radial internal extremity 53.

The armatures 43 are guided by guide members 54 and 56 of the intermediate body 19 for oscillating along radial planes including the axis 33. A ring 57 of elastomeric material holds the step configurations 51 in contact with the internal faces 46 of the cores 41 and the internal extremities 52 arrested against a ring 58 of viscostatic material. The rings 57 and 58 are maintained in operative position by respective seats of the intermediate body 19 and the actuating body 21 of the head 10.

A structure of this type is partially described in the U.S. Pat. No. 4,995,743 assigned to Ing. C. Olivetti & C., S.p.A. and Incorporated herein by reference.

In the printing head 10 of FIG. 1 and in contrast to the head of the cited U.S. Pat. No. 4,995,743, the internal extremities 38 are directly soldered to the internal extremities 53 of the movable armatures 43, for instance in the manner described in the U.S. Pat. No. 5,054,942 assigned to Ing. C. Olivetti & C., S.p.A. and also incorporated herein by reference. The actuation of the windings 42 causes the actuation of the armatures 43 and the pushing of the wires 28 against the support 12, through the extremities 53. The stroke of the printing extremity 37 of each wire 28 will be defined by the arrest of the external extremity 52 against the face 44 of the core 41 of the corresponding electromagnet 40.

Figure 4:
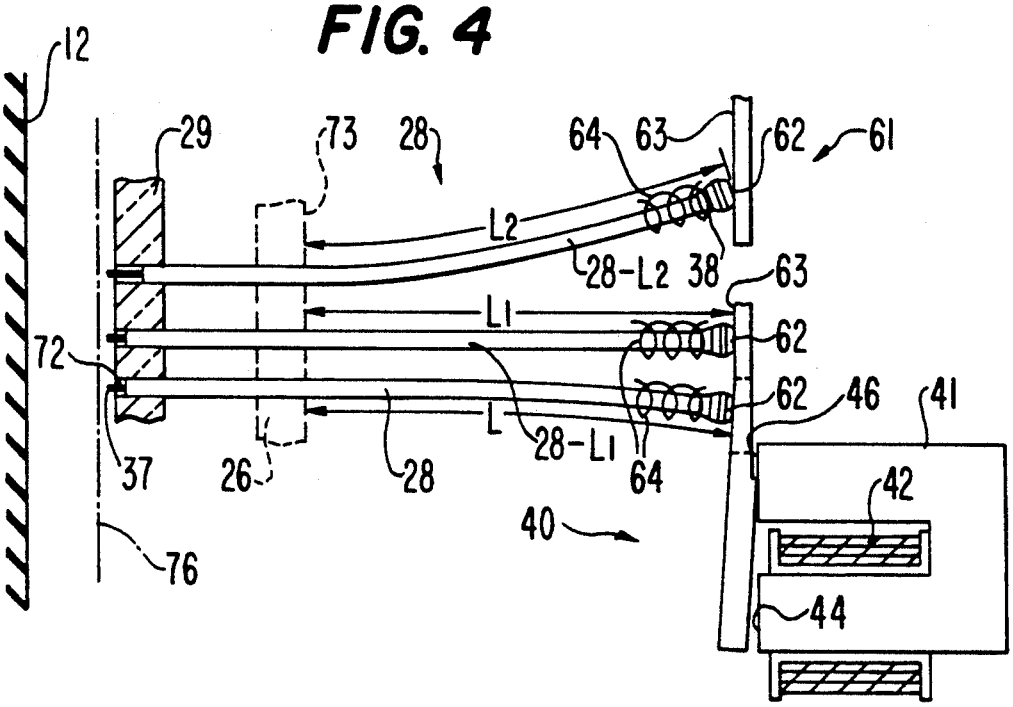
FIG. 4 is a schematic diagram of an alternative form of the printing head of FIG. 1.

The present invention is also applied in the printing head of FIG. 4 with reference numeral 61, in which the internal extremities 38 of the wires 28 are embedded in a cap 6 of plastic material. The caps 62 bear on the internal extremities of the armatures 43, indicated by reference numeral 63, by the action of corresponding springs 64, according to the cited European Application No. 0,323,418. In this last case the armatures 43 operate on the wires 28 in a ballistic way, upon excitation of the windings 42. In particular the caps 62 are striken by the armatures 43 and leave the extremities 63 after the arrest of the armatures on the cores, whilst the printing extremities 37 strike the platen 12 after a stroke of inertial type. The wires 28 are then restored by the springs 64 in a manner known per se.

Either in the case of controlled strokes and in the case of inertial strokes the printing of dots occurs whilst the carriage is moving at constant velocity in front of the platen 12. In the case in which a striking printing wire meets an ostacle, such as an edge of the recording medium 17, the simultaneous movement of the carriage causes an over-stress by bending in the projecting portion of the wire.

The amount of the over-stress increases on the increasing of the displacement velocity of the carriage and the distance of the guide matrix from the platen 12, on the increasing of the resilience of the obstacle and on the decreasing of the section of the wire. A reduced velocity of the carriage will cause a reduced printing speed. However to avoid the ribbon 13 dirtying the recording medium, the guide matrix cannot be too close to the same recording medium 17. The permanent deformations on the terminal portions of the wires hamper a free movement of the wires in the guide matrix with risks of arrest in the printing.

Figure 2:
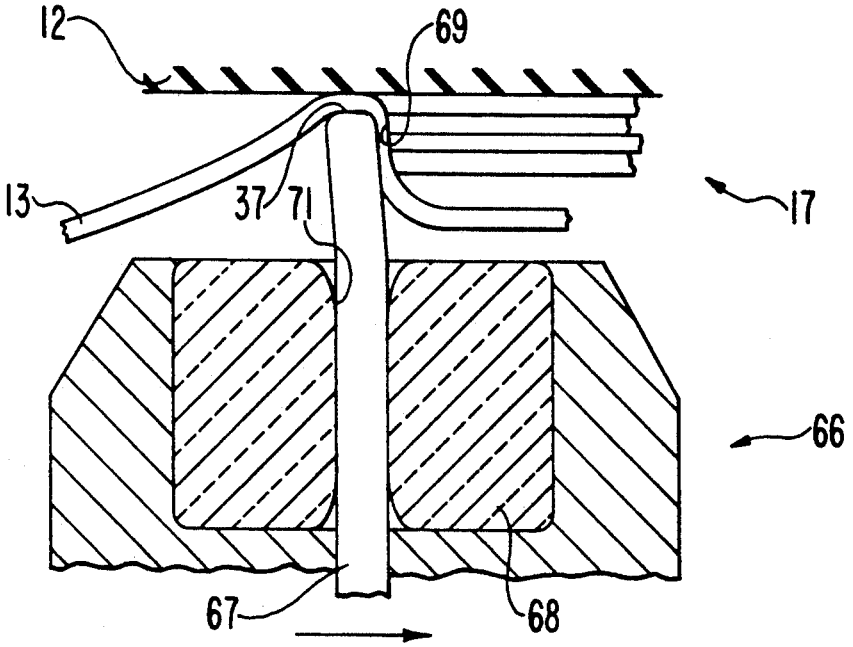
FIG. 2 is a schematic plan of a known printing head.
Figure 5:
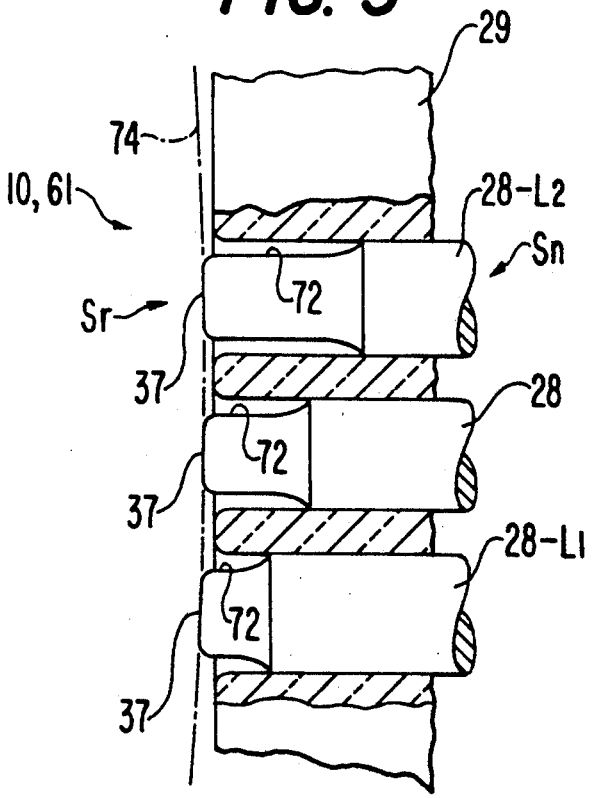
FIG. 5 shows enlarged detail of the head of FIGS. 1 and 4.

FIG. 2 shows a printer indicated with reference numberal 66, comprising thin wires 67 and a guide matrix 68 in an abnormal operative phase, in which during the printing of a dot, a wire 67 actuated for the print has met, as obstacle, a thick edge 69 of the recording medium 17. This situation can occur when the adjustment mechanism of the distance of the printing head in the printer falls to withdraw the head from the platen 12. The wire 67 will be over-stressed by bending and will be permanently deformed in its portion projecting from the guide matrix 68. In particular the diameter of wire 67 is about 0.20 mm, the distance between the front of the guide matrix 68 and the recording medium 17 is 0.30 mm an the thickness of the recording medium 17 is 0.30 mm.

It has been observed that the deformation of thin wires 67, in the case of a clash against obstacles during the printing, occurs in a guide zone 71 of the matrix 68, which is a little more than 2.5–4.5 times the diameter of a wire, for wires having a diameter of 0.15–0.25 mm. In the case of wires having a diameter of 0.20 mm and in the operative conditions of FIG. 2, this distance results about 0.50–0.90 mm.

Figure 7:
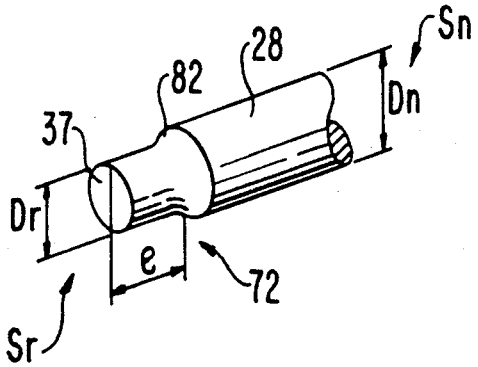
FIG. 7 is a perspective view of an element of the head of FIG. 1.

On the basis of observations and experiments, the printing head 10 of the invention provides in each wire 28 (FIG. 7) a nominal section "Sn" corresponding to a nominal diameter "Dn" greater than the area of the printing extremity 37, which generates the imprint of the dot to be printed. The wire 28 has a front portion 72, adjacent the extremity 37, which has a constant section "Sr" corresponding to a diameter "Dr" which is reduced relative to the section "Sn" and the diameter "Dn", respectively.

Figure 3:
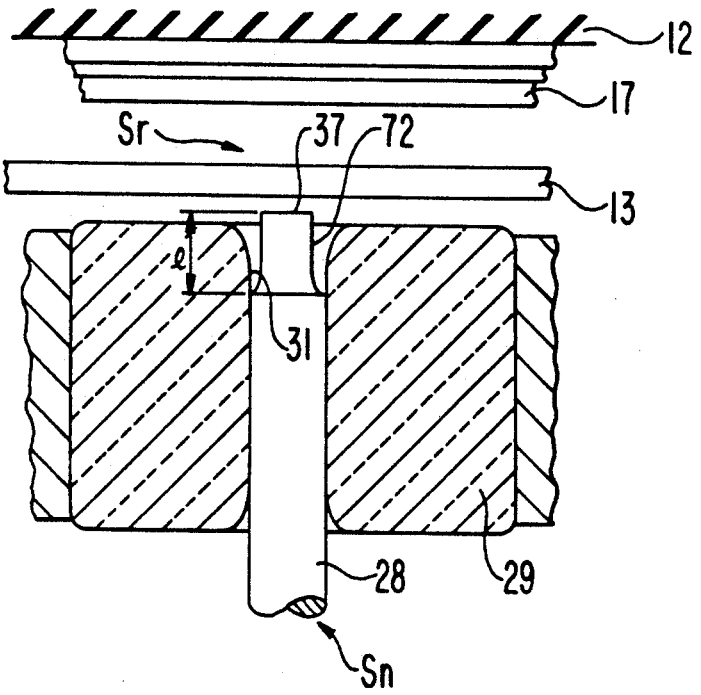
FIG. 3 is a schematic plan of the head of FIG. 1.

The frontal portion 72 of each wire 28 extends over a length "l" approximately equal to 2Dr. The holes 31 of the guide matrix 29 (FIG. 6) are dimensioned to exactly guide the terminal portion of the wire 28 having the nominal section "Sn" and diameter "Dn". In this manner and in the case of clash of the extremity 37 (FIG.3) against an obstacle, the section of wire subject to the maximum stress will be located in a portion of wire having the nominal section "Sn". The wire of the invention will react as if its section is "Sn" also in its terminal section. Moreover also in the case of clash causing small permanent deformations the play existing between the frontal portion 72 of reduced section and the hole 31, which is greater than the nominal section, will enable a free movement of the wire 28 in the guide matrix 29.

The best results will be obtained for small values of the length "l". However the minimum value of the length "l" is bound by the fact that the colored pigments released from the ribbon 13 to the recording medium 17, should be carried by the sole reduced section "Sr" and not by the nominal section "Sn" to avoid enlargement of the area of the printed dot.

In the printing head 10, 61 of the invention, the wires 28 have a nominal diameter Dn of 0.25 mm and a reduced diameter Dr of 0.20 mm equal to 80% of Dn. The imprinting area is greater than the section "Sr" in view of the enlargement due to the thickness of the ribbon and to the penetration of the wire. The minimum acceptable length "l" has been fixed to limit the enlarged imprinting area to be not more than the nominal section "Sn" in the case of maximum penetration of the surface 37 and in an operative condition in which the ribbon 13 is of multistrike type of a thickness of 26±1 um and the recording medium is of a standard type. This minimum acceptable value is 0.10 mm equal to 0.5Dr, when the wire is worn out to the end. In a new printing head the minimum value of "l" is about equal to "Dr".

The maximum value of "l" is limited by the fact that the section of wire subject to bending should be located in the portion of wire having the nominal section "Sn". This maximum value is equal to about 3Dr, 0.60 mm in the case of a wire in which Dr is about 0.20 mm. Greater values of "l" up to 4.5Dr are also acceptable without substantial drawbacks.

The wires 28 have different length internally to the printing head 10, 61 in view of the fact that the printing extremities 37 are aligned according to two columns whilst the internal extremities 38 are disposed on a frusto-conical surface in the case of the head 10 and on two frusto-conical surfaces in the case of the head 61. Between an internal surface 73 (FIG. 4) of the wall 26 and the internal extremities 53, 63 of the armatures 43, the wires 28 provide a length "L" included between a minimum value "L1" for wires 28-L1 having a rather "straight" configuration and a maximum value "L2" for wires 28-L2 having a "curved" configuration.

Figure 8:
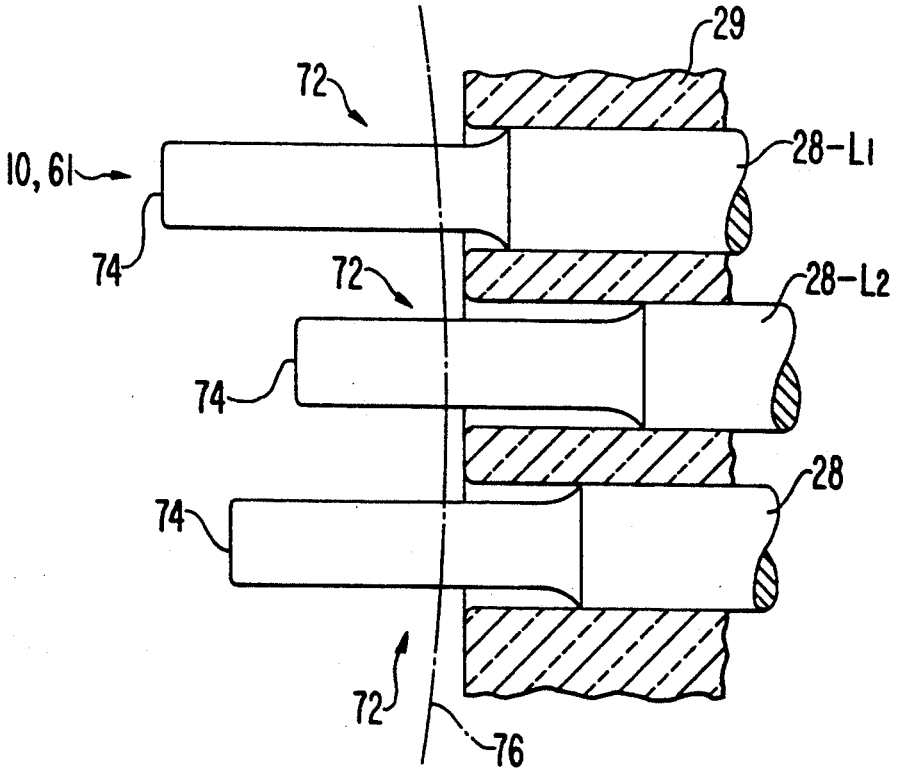
FIG. 8 shows an aspect of the details of FIG. 5 during assembly of the head of FIGS. 1 and 4.

In the printing head 10 the differences in the trajectories of the wires are limited, and the wires 28 provide an equal length before their assemblying. In the printing head 61 the differences in the trajectories of the wires are greater, and the wires 28 are dimensioned to provide two different lengths between the extremities 37 and 38: the greatest length for the wires 28-L2 and the smallest for the wires 28-L1 and 28-L. For an easy mounting, the wires of different length include colored indexes or labels associated to their position in the head. The length "l" of the portion 72 is optimized to be equal to 4Dr. Consequently, the extremities of the wires 28 having the reference numeral 74 will project more or less with respect to the guide matrix, after the assembling of the wires in the heads 10 and 61 (FIG. 8).

In accordance with an embodiment of the invention, the front portions 72 of the wires 28 can be ground without modifying the respective impact sections. In this manner, when the head is assembled, all the printing surfaces 37 will be, at rest, spaced apart an equal distance from the platen 12 and on a common surface 76 parallel to the platen 12. The grinding operation enables obtaining lengths of the frontal portions 72 equal approximately to 2Dr±Dr.

To simplify the grinding operations, the wall 26 and the guide matrix 29 are fixed to an L shaped terminal support 77 (FIG. 1). The support 77 is mounted on the nose 18 and can be adjusted longitudinally, by means of a cylindrical seat 78 engaged in a notch 79 of the nose 18 and a screw 81 locked in the seat 78. The grinding of the extremities of the wires will occur after a previous approaching of the support 77 toward the intermediate body 19. This operation can be performed also in the case of a grinding operation following the replacement of wires due to abnormal wear or breakage of the wires.

The operations of grinding on the frontal portions 72 of reduced section do not cause enlargement on the area of a printed dot. In fact the section "Sr" in the portion "l" is constant in dependence of the constant value of the diameter "Dr" in the section 72 of reduced value.

The thickness of the guide matrix 29 depends on the type of used material for its manufacturing. In the case of synthetic ruby, the thickness is 5Dn equal to about 1.20 mm. In the case of use of other less hard material, as plastics loaded with glass fibers, the thickness is greater, as 8Dn, equal to about 2.00 mm. The pitch Pr of the wires in a column and the distance Pt between the columns are 1.13Dn and 1.40Dr, equal to 0.282 (1/90") and 0.85 mm (1/30") respectively.

The reduction of section from the value "Sn" to the value "Sr" (FIG. 7) is obtained according to known grinding operations and provides a fillet portion 82 between the diameters "Dn" and "Dr".

It is clear that modifications and alterations may be made in the above-described printing head without thereby departing from the scope of the invention. By way of example, the wires may be oval in section or provide a rectangular terminal portion and in this case, the considerations affecting the diameters Dr and Dn are applied to the minimum transverse dimension of the wires.

The invention provides very favourable results, even when the wires are more numerous and of smaller diameter than the above-described wires. In particular, this invention may be applied to a printing head comprising 64 wires with a nominal diameter Dn=0.22 mm and in which the reduced portion 72 has a reduced diameter Dr=0.16 mm for a length l=0.10–0.40 mm, for the printing of an original sheet and a copy sheet.

What is claimed is:

1. A wire printing head for a high resolution printing machine, comprising a printing platen for a recording medium and a carriage transversely movable with respect to the printing platen and mounting the printing head, said head comprising a guide matrix adjacent the platen and a plurality of wires each one having a given nominal section (Sn), the wires being guided by holes in the guide matrix and longitudinally movable to define a corresponding plurality of printing dots on the recording medium and each of the printing wires having a front portion of constant reduced section (Sr) with respect to the nominal wire section and a minimum transverse dimension (Dr);

wherein each of said front portions extends longitudinally for a minimized length (l) of between 0.5 and 4 times the minimum transverse dimension of said front portion; and wherein each of the holes in the guide matrix slidably supports and guides a terminal portion of the wires adjacent to said front portion and having said given nominal section and in which the holes in the guide matrix receive a part of the front portions of said printing wires with clearance therebetween.

2. A printing head according to claim 1, wherein the printing wires have circular section Dn and said front portion has a reduced diameter Dr=0.8Dn and a length approximately equal to 2Dr±Dr.

3. A printing head according to claim 1, wherein the printing wires have different lengths, corresponding to different curvatures of the wires within the printing head.

4. A printing head according to claim 1, wherein said guide matrix comprises means for sliding with respect to a main body of the printing head for causing a partial projection of the front portions of the wires from the guide holes for grinding operations.

5. A printing head according to claim 1, wherein the printing wires have a nominal diameter (Dn) of about 0.25 mm in the portion of nominal section and a reduced diameter (Dr) of about 0.20 mm in the portion of reduced portion and a minimized length of 0.40±0.20 mm.

6. A wire printing head according to claim 1, wherein said guide matrix has a thickness of about 5 times said minimum transverse dimension.

7. A method for manufacturing a wire printing head for a high resolution printing machine, comprising a printing platen for a recording medium and a carriage movable transversely with respect to the printing platen and for mounting the printing head and wherein the head comprises a guide matrix adjacent the platen and a plurality of wires having a given nominal section (Sn), guided in holes of the guide matrix and longitudinally movable to define a corresponding plurality of printing dots on the recording medium, and a plurality of electromagnets for actuating the said wires, said method comprising the steps of:

a) providing on each wire a front portion of a constant section (Sr), reduced with respect to the nominal section (Sn), and adjacent to a terminal portion of the wire having said given nominal section, said front portion having a minimum transverse dimension (Dr) thereof;

b) providing for a longitudinal adjustment of said guide matrix relative to said electromagnets;

c) assembling the wires with the electromagnets and the guide matrix so that the guide matrix slidably supports said terminal portion of the wires having said nominal section;

d) moving the guide matrix to cause the front portions of a constant section to project from said guide matrix; and e) grinding said front portions to cause their printing surface to be substantially coplanar to a common surface parallel to said platen and such that said front portions extend longitudinally for a minimized length (l) of between 1 and 3 times said minimum transverse dimension (Dr).

8. A method for manufacturing a wire printing head according to claim 7, wherein the printing wires have different lengths before the assembly, in dependence on their position in the guide matrix.

9. A method for manufacturing a wire printing head according to claim 8, wherein said wires have extremities opposite to said printing extremities which are disposed on two different frusto-conical surfaces and in which each wire has one of two different lengths dependent on which frusto-conical surface it is disposed.

10. The method for manufacturing a wire printing head according to claim 8, wherein said wires of different length include identification indexes of different color.

11. A wire printing head for a high resolution printing machine, comprising a printing platen for a recording medium and a carriage transversely movable with respect to the printing platen and mounting the printing head, said head comprising a guide matrix adjacent the platen and a plurality of wires each one having a given nominal section (Sn), the wires being guided by holes in the guide matrix and longitudinally movable to define a corresponding plurality of printing dots on the recording medium and the printing wires including terminal portions each having said given nominal section and front portions adjacent to said terminal portions, said front portions defining associated printing extremities and each having a constant section (Sr) reduced with respect to said given nominal section (Sn) with a minimum transverse dimension (Dr);

wherein the printing wires have different lengths (L) corresponding to different curvatures and/or internal lengths of the wires within the printing head and the printing extremities are coplanar with a common surface parallel to the platen;

wherein the holes in the guide matrix slidably support and guide said terminal portions having said given nominal section and receive a part of the front portions of said printing wires with clearance; and wherein said front portions each extend longitudinally through a different amount for a minimized length (l) of between 0.5 and 4 times said minimum transverse dimension (Dr).

* * * * *